US006007437A

United States Patent [19]

Schickert et al.

[11] Patent Number: 6,007,437

[45] Date of Patent: Dec. 28, 1999

[54] STRUCTURAL FOAM BASKETBALL BACKBOARD WITH INMOLD GRAPHICS

[75] Inventors: Randy R. Schickert, Kewaskum; James N. Fitzsimmons, Waukesha, both of Wis.

[73] Assignee: Huffy Corporation, Miamisburg, Ohio

[ * ] Notice: This patent is subject to a terminal disclaimer.

[21] Appl. No.: 08/814,558

[22] Filed: Mar. 11, 1997

Related U.S. Application Data

[63] Continuation of application No. 08/190,914, Feb. 3, 1994, Pat. No. 5,626,339.

[51] Int. Cl.[6] ..... A63B 63/08

[52] U.S. Cl. ..... 473/481

[58] Field of Search ..... 473/481

[56] References Cited

U.S. PATENT DOCUMENTS

| | | | |
|---|---|---|---|
| D. 216,722 | 3/1970 | Minnette | D34/5 |
| D. 229,430 | 11/1973 | Fortin | D34/5 VV |
| D. 235,897 | 7/1975 | Breneman | D34/5 VV |
| D. 263,161 | 2/1982 | Quinones | D21/201 |
| D. 315,185 | 3/1991 | Maloney | D21/201 |
| D. 320,637 | 10/1991 | Fish, Jr. et al. | D21/201 |
| D. 330,059 | 10/1992 | McGivern et al. | D21/201 |
| D. 336,500 | 6/1993 | Driska | D21/201 |
| D. 338,934 | 8/1993 | Vander Weide | D21/201 |
| D. 348,710 | 7/1994 | Tager et al. | D21/201 |
| D. 350,797 | 9/1994 | Curtis | D21/201 |
| D. 357,518 | 4/1995 | Hansberry | D21/201 |
| T984,007 | 7/1979 | Richardson . | |
| 1,950,196 | 3/1934 | Slusher . | |
| 2,932,511 | 4/1960 | Bemis | 273/1.5 |
| 3,072,969 | 1/1963 | Du Bois . | |
| 3,122,598 | 2/1964 | Berger . | |
| 3,270,101 | 8/1966 | Jardine et al. . | |
| 3,546,748 | 12/1970 | Gardner . | |
| 3,788,642 | 1/1974 | Matras | 273/1.5 R |

(List continued on next page.)

FOREIGN PATENT DOCUMENTS

| | | |
|---|---|---|
| 952674 | 8/1974 | Canada . |
| 1215242 | 4/1960 | France . |
| 609018 | 9/1960 | Italy . |
| 42-6183 | 12/1962 | Japan . |
| 46-9959 | 12/1965 | Japan . |
| 43-7458 | 3/1968 | Japan . |
| 5 3143-655 | 5/1977 | Japan . |
| 5 5034-913 | 9/1978 | Japan . |
| 5 1750-971 | 3/1981 | Japan . |
| 6 2140-807 | 12/1985 | Japan . |
| 2-244189 | 9/1990 | Japan . |
| 584769 | 4/1993 | Japan . |
| 6706593 | 11/1967 | Netherlands . |
| 143168 | 9/1974 | Netherlands . |
| 2 039 465 | 8/1980 | United Kingdom . |

OTHER PUBLICATIONS

Porter, "Celebrate 100 Years of Baskbell," catalog.

Huffy Sports, "Our All–Star Lineup" catalog.

Lifetime Products, Inc. "Institutional Basketball Equipment" catalog.

(List continued on next page.)

*Primary Examiner*—William H. Grieb

*Attorney, Agent, or Firm*—Howrey & Simon; Michael J. Bell; Andrew R. Kopsidas

[57] ABSTRACT

A basketball backboard formed of a structural foam material such as structural foam polypropylene. The backboard is provided with an inmolded graphics sheet formed of the same material as that used to form the backboard. The graphics sheet of material is formed with pores to receive the printing inks whereby a desired visual graphics display is provided on an exposed facing surface of the graphics sheet. The backboard is formed as a high strength rigid structure having good rebound characteristics.

22 Claims, 5 Drawing Sheets

U.S. PATENT DOCUMENTS

| | | | |
|---|---|---|---|
| 3,806,398 | 4/1974 | Lasser . | |
| 3,964,743 | 6/1976 | Salsich, Sr. | 273/1.5 R |
| 4,016,235 | 4/1977 | Ferro . | |
| 4,294,789 | 10/1981 | Lincoln et al. . | |
| 4,402,262 | 9/1983 | Handforth | 101/129 |
| 4,412,679 | 11/1983 | Mahoney et al. | 273/1.5 |
| 4,424,968 | 1/1984 | Smith | 273/1.5 R |
| 4,478,415 | 10/1984 | Shaffer et al. . | |
| 4,731,279 | 3/1988 | Isshiki | 52/309.9 X |
| 4,793,611 | 12/1988 | Thornell | 273/1.5 R |
| 4,917,927 | 4/1990 | Sakaitani et al. . | |
| 4,931,248 | 6/1990 | Willemin . | |
| 5,030,407 | 7/1991 | Mollet et al. . | |
| 5,039,468 | 8/1991 | Sellers . | |
| 5,061,428 | 10/1991 | Batchelder . | |
| 5,082,261 | 1/1992 | Pelfrey . | |
| 5,108,818 | 4/1992 | Ebina et al. . | |
| 5,211,593 | 5/1993 | Schneider et al. . | |
| 5,224,699 | 7/1993 | Zaruba | 273/1.5 R |
| 5,227,222 | 7/1993 | Ogawa et al. . | |
| 5,236,636 | 8/1993 | Tisack . | |
| 5,238,630 | 8/1993 | Tung . | |
| 5,264,172 | 11/1993 | Rosica et al. . | |
| 5,354,049 | 10/1994 | Matherne et al. | 273/1.5 R |
| 5,354,053 | 10/1994 | Ratner et al. . | |
| 5,411,688 | 5/1995 | Morrison et al. . | |
| 5,433,432 | 7/1995 | Adler | 273/1.5 R |
| 5,484,560 | 1/1996 | Moriyama et al. . | |
| 5,512,227 | 4/1996 | Grazioli . | |
| 5,604,006 | 2/1997 | Ponchaud et al. . | |
| 5,626,339 | 5/1997 | Schickert et al. | 473/481 |

OTHER PUBLICATIONS

Plastics World, Feb. 1963, , Hochner, W.L., "In–Mold Decoration".

Fisher–Price, Toy Basketball Unit (color copies of photographs #1), third party alleged date circa 1988.

Today's Kids, Toy Basketball Unit (color copies of photographs #2), third party alleged date circa 1988.

Aviva, Sports Slap II Unit, (color copies of photographs #3), third party alleged date circa 1992.

Today's Kids, All Star Basketball, (color copies of photographs #4), third party alleged date circa 1988.

Little Tikes, Easy Score Basketball, (color copies of photographs #5), third party alleged date circa 1988.

Fisher–Price, Grow To Pro Basketball, (color copies of photographs #6), third party alleged date circa 1992.

DP M–Pact Basketball Backboard and Goal Combination, third party alleged date 1986 (see,particularly, E–1).

DP Fit For Life, dated 1990 (see, particularly, E2–E9).

Harvard 1988 Sporting Goods Catalog, dated 1988 (see, particularly, E10).

Lifetime, Graphite Slam–it, third party alleged date Oct. 1, 1990 (see, particularly, E11).

Lifetime, Slam Dunk Model 1098, third party alleged date Sep. 1993 (see, particularly, E12).

Lifetime, Slam Dunk Model 1892, third party alleged date Oct. 1991 (see, particularly, E13).

Lifetime, Slam Dunk Model 2820, third party alleged date Jan. 1993 (see, particularly, E14).

Lifetime, Slam Dunk Model 1621, third party alleged date Jan. 1993 (see, particularly, E15).

Lifetime, Transcourt Model 1212, third party alleged date Feb. 1993 (see, particularly, E16).

Lifetime, Quick Adjust Model 4125, third party alleged date Apr. 1990 (see, particularly, E17).

Lifetime, Quick Adjust Model 4826, third party alleged date Jan. 1993 (see, particularly, E18).

Lifetime, Combo Model 3820, third party alleged date Sep. 1993 (see, particularly, E19).

Lifetime, Quick Court, third party alleged date Mar. 14, 1994 (see, particularly, E20).

Lifetime, World Class, third party alleged date Aug. 1994 (see, particularly, E21).

Lifetime, Overtime, third party alleged date Jun. 10, 1994 (see, particularly, E22).

Lifetime, Hangtime, third party alleged date Oct. 3, 1993 (see, particularly, E23).

Lifetime, 3600 Back, third party alleged date pre–1993 (see, particularly, E24).

Lifetime, Pro Glass, third party alleged date pre–1993 (see, particularly, E25).

Porter, "Celebrating 100 Years of Basketball", dated 1991 (see, particularly, E26).

Porter, Sports Equipment, dated 1991 (see, particularly, E27–E33).

Spalding, Backboard, third party alleged date unknown (see, particularly, E34–E43).

Huffy, Performance Series Models 80381 and 80382, Feb. 3, 1994.

Huffy, 81373 In The Paint, Feb. 1994 (see, particularly, E44).

Huffy, 81374 In The Paint, Feb. 1994 (see, particularly, E45).

Huffy, 81404 Powrglas NCAA, Feb. 1994 (see, particularly, E46).

Huffy, 85405 Graphite NCAA, Feb. 1994 (see, particularly, E47).

Huffy, 79406 Framed Acrylic NCAA, Feb. 1994 (see, particularly, E48).

Huffy, Model 79340 Pro Classic, Feb. 1994 (see, particularly, E49).

Huffy, Center Court–Get Vertical, Feb. 3, 1994.

Huffy, Graphite Slam Jam, Aug. 1988.

Huffy, 8855, Feb. 1989 (see, particularly, E50).

Huffy, 8819, Feb. 1989 (see, particularly, E51).

Huffy, 8802C, Feb. 1989 (see, particularly, E52).

Huffy, 8405A, Feb. 1989 (see, particularly, E53).

Huffy, 8717, Feb. 1989 (see, particularly, E54).

Huffy, 8117, Feb. 1989 (see, particularly, E55).

Huffy, 8858, Feb. 1989 (see, particularly, E56).

Huffy, 8866, Feb. 1989 (see, particularly, E57).

Huffy Youth Sports styrene basketball backboard (admitted prior art).

SureShot polystrene, structurally foamed basketball backboard (admitted prior art).

STRUCTURAL FOAM BASKETBALL BACKBOARD WITH INMOLD GRAPHICS

This application is a continuation of application Ser. No. 08/190,914, filed Feb. 3, 1994, which issued as U.S. Pat. No. 5,626,339 on May 6, 1997.

BACKGROUND OF THE INVENTION

The present invention relates to a basketball backboard and, more particularly, to a basketball backboard formed of a structural foam plastic material and having a graphics sheet molded into the face of the backboard.

Basketball backboards are currently made of a variety of materials and are commonly produced using a moldable plastic material. In one known backboard structure the backboard is formed of styrene which is injected into a straight injection mold to form the styrene into the final desired shape for the backboard. Further, such styrene backboards are typically formed as small backboards, i.e. less than 48 inches.

It is also known to provide the above-described styrene backboard with a front face having a graphics display to improve the appearance of the backboard. Typically, the graphics display is printed on a styrene sheet which is laid by hand into the mold for forming the backboard and alignment of the sheet is accomplished by aligning holes in the sheet on pins in the mold provided for producing the mounting holes in the backboard. Upon injecting styrene into the mold, the back portion of the graphics sheet is melted to cause it to be integrally joined to the face of the backboard.

Styrene is relatively easy to print on and therefore is conducive to the production of backboards which are provided with sheets having graphics printed thereon. However, there is a need for a molded backboard formed of a plastic material having greater structural strength than prior molded backboards and which is conducive to production of larger backboards, such as 48 inch backboards. In addition, it is desirable to provide such a backboard wherein the material forming the backboard is conducive to receiving a printed sheet of graphics material formed of the same material as that of the backboard.

SUMMARY OF THE INVENTION

The present invention provides a basketball backboard which is formed of a structural foam plastic material, such as a polyolefin, molded in an injection molding operation. By molding the backboard using a structural foam material, the backboard is provided with an internal cellular structure and has a tough external skin which provides good rebound characteristics.

In addition, the present invention includes a printed graphics sheet formed of a material compatible with the backboard material, such as one formed of the same base resin material. The graphics sheet is bonded to the backboard simultaneously with the molding operation of the backboard such that the graphics sheet is inmolded with the backboard structure. It has been found that there is greater difficulty associated with printing on polyolefin materials than with printing on the prior art styrene material in that the exterior surfaces of parts formed of polyolefin based materials are relatively non-porous and are therefore not receptive to printing inks. The present invention further provides a method of preparing the surface of the graphics sheet to ensure that a high resolution printed graphics sheet is provided for attachment to the backboard.

In one aspect of the present invention, a method of producing a basketball backboard of a structural foam material is provided comprising the steps of providing a mold, placing a graphics sheet in the mold wherein the graphics sheet is formed of a material which is compatible with the structural foam material and includes a printed side, and supplying a melt of structural foam material to the mold to thereby form a rigid backboard structure and simultaneously bond the graphics sheet to the backboard structure.

In a further aspect of the invention, the method includes registering a peripheral edge of the graphics sheet with a surface in the mold to align the graphics sheet relative to the mold. Preferably, the alignment surface in the mold defines a recess in the backboard extending around substantially the entire periphery of the graphics sheet.

In yet another aspect of the invention, both the graphics sheet and the backboard structure are formed of polyolefins including polyolefins having additives and fillers. In addition, the graphics sheet is corona treated during production of the sheet, prior to printing of the sheet, to thereby produce pores in the sheet for receiving ink during printing of the sheet.

It is therefore an object of the present invention to provide a method of producing a molded structural foam backboard.

It is another object of the present invention to provide a structural foam backboard having an inmolded graphics sheet attached thereto wherein the graphics sheet is formed of the same basic material, or other compatible material, as the structural foam backboard.

Other objects and advantages of the invention will be apparent from the following description, the accompanying drawings, and the appended claims.

DETAILED DESCRIPTION OF THE PREFERRED EMBODIMENT

Figure 1:
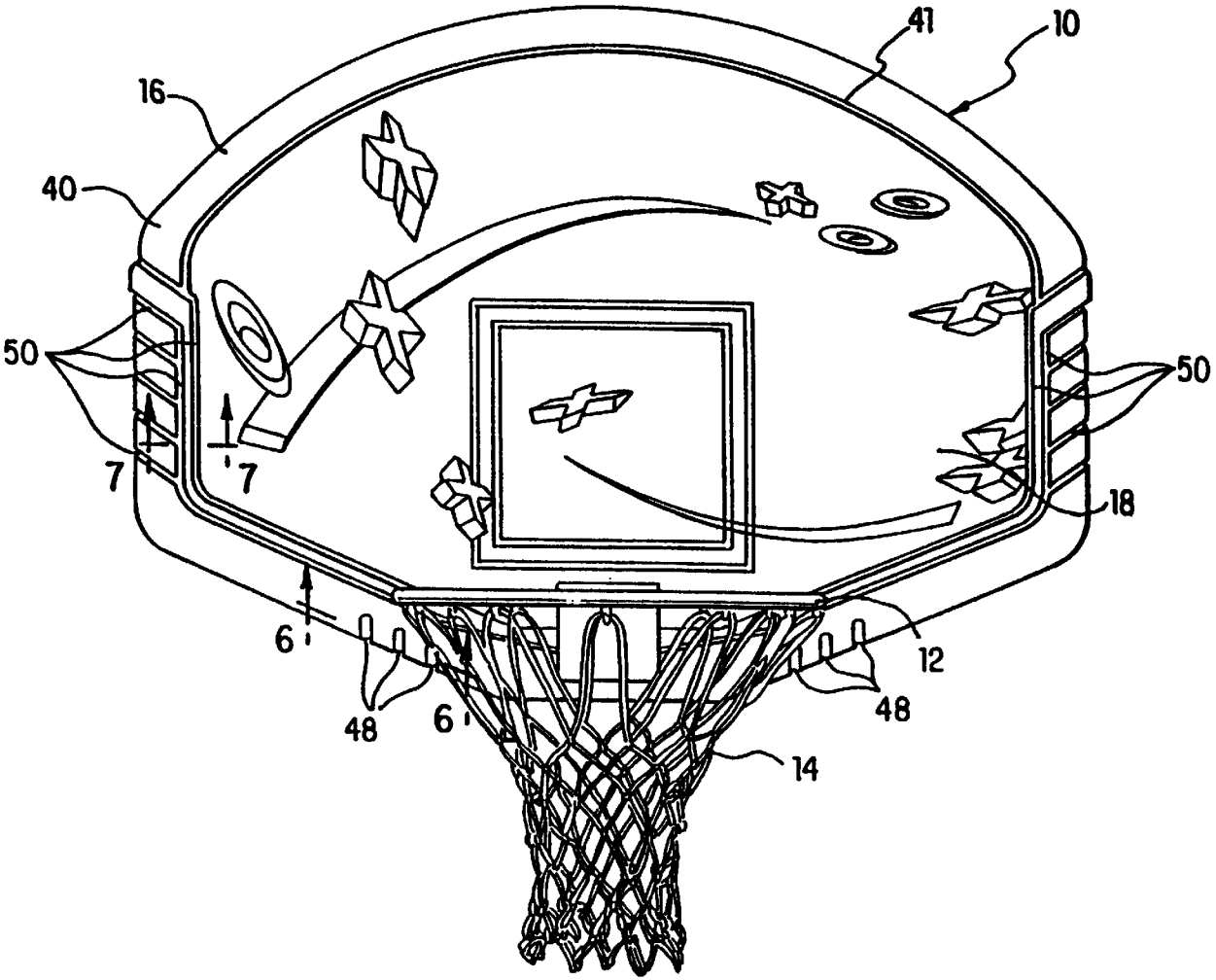
FIG. 1 is a front elevational view showing the backboard of the present invention.

Referring to FIG. 1, the backboard 10 of the present invention is illustrated having a hoop 12 and net 14 attached thereto. The backboard 10 includes a rigid backboard structure 16 and a thin graphics sheet 18 attached to the front face of the rigid structure 16.

In the preferred embodiment, both the rigid backboard structure 16 and the graphics sheet 18 are formed of polyolefin based materials which comprise a family of materials including polypropylene and polyethylene. The graphics sheet 18, which is preferably formed of the same base resin material as the rigid structure 16, is inmolded into the rigid structure 16 such that the graphics sheet 18 is substantially integrally bonded to the rigid structure 16. The polyolefin material forming the rigid backboard structure 16 comprises a particularly strong and cost effective material for the rigid backboard structure 16. In addition, the rigid structure 16 is preferably molded into the desired backboard shape during a molding operation wherein the rigid structure 16 is formed as a molded structural foam structure. As will be described further below, the polyolefin material forming the rigid structure is shot into the mold to form a structural foam polyolefin backboard characterized by an internal cellular structure having a tough external skin to provide a high strength rigid backboard which has good rebound characteristics and which is resistant to cracking in cold weather. It should also be noted that the polyolefins forming the backboard for the present invention may include polyolefins having additives and fillers to obtain the desired characteristics for the backboard.

Figure 2:
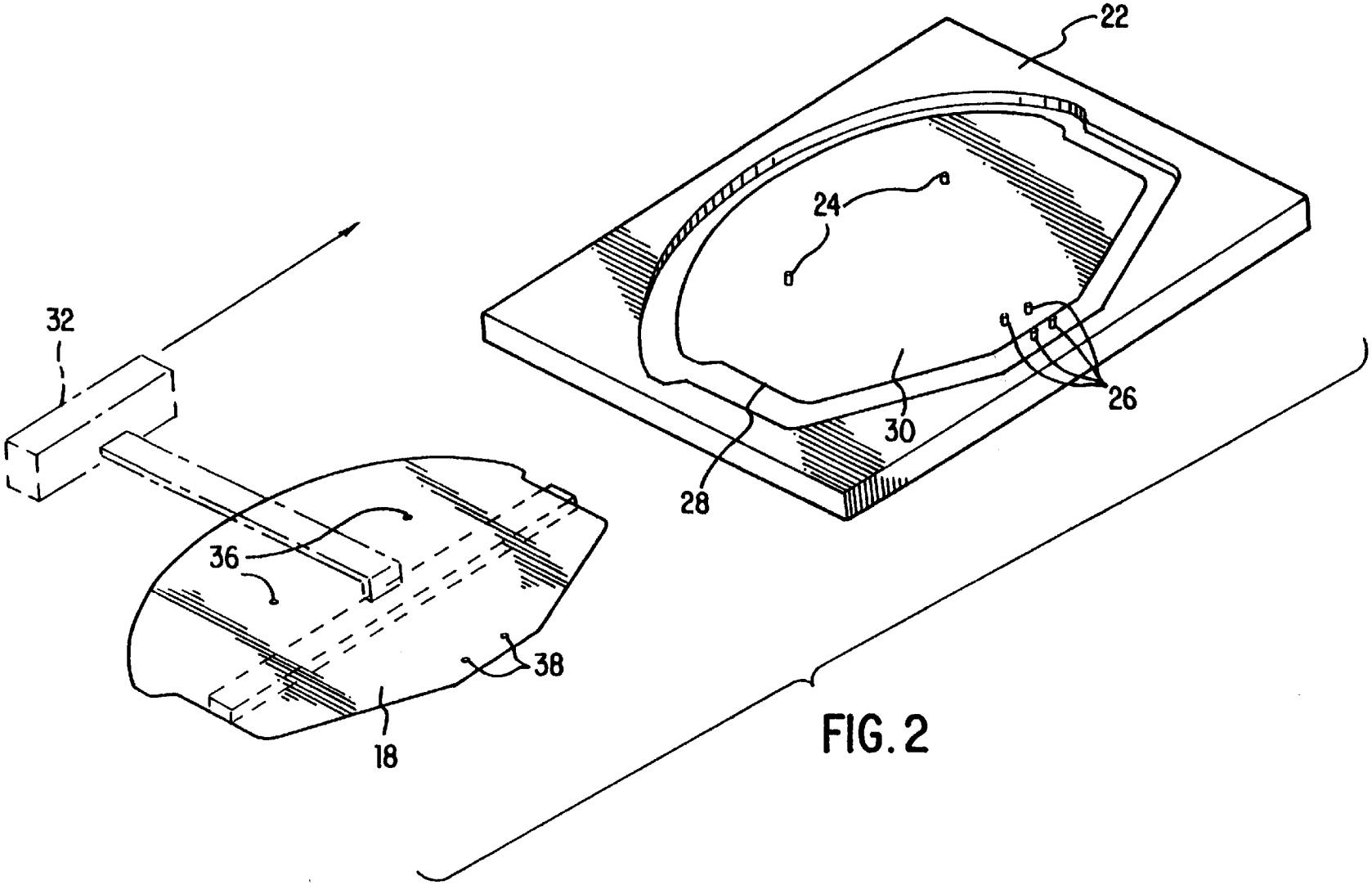
FIGS. 2–4 illustrate steps of the method for forming the backboard of the present invention.
Figure 3:
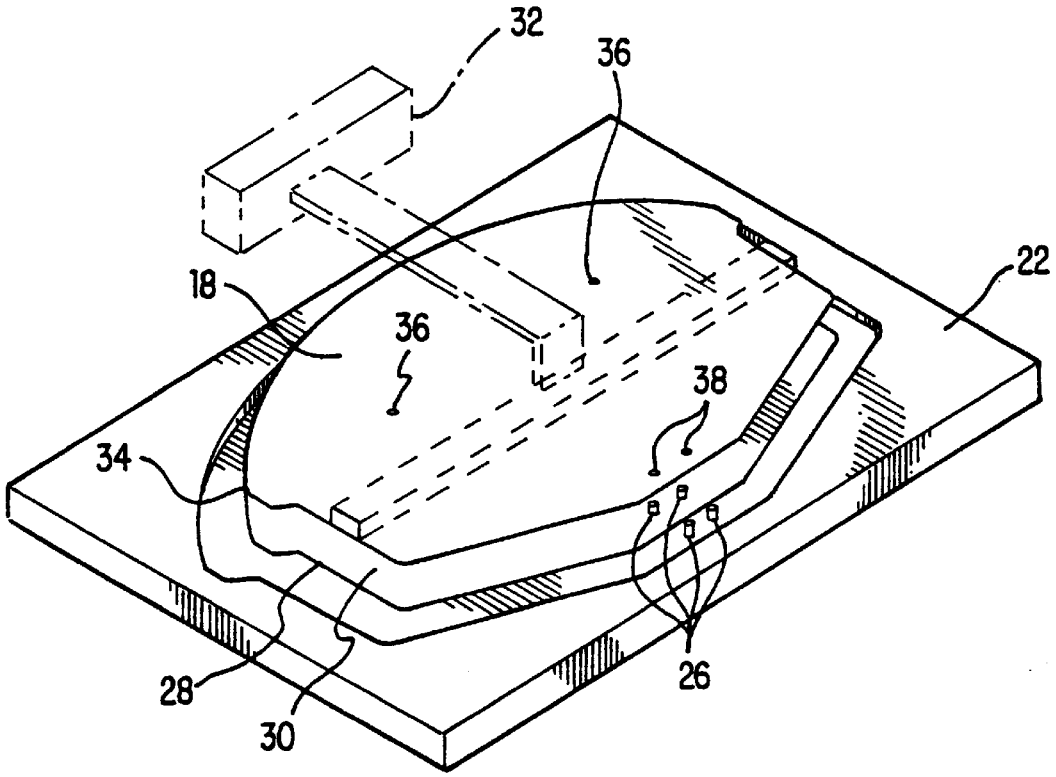
Figure 4:
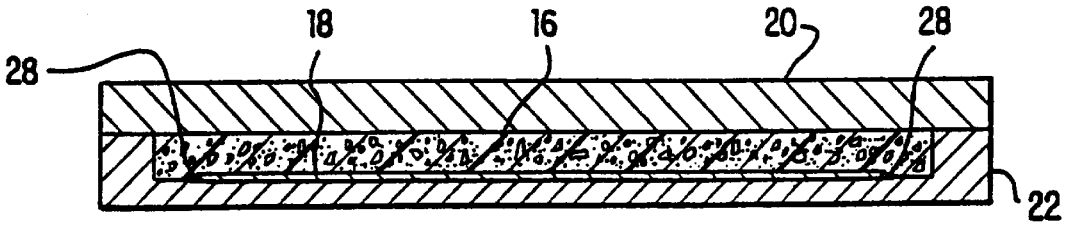

Referring to FIGS. 2–4, the backboard 10 is formed through a molding operation in a mold which may consist of a first or core half 20 and a second or cavity half 22. It should be understood that the mold shown in the figures is provided for illustrative purposes only to illustrate the steps of the method for forming the present backboard and that various details of the mold not required for the present description are not shown. Also, other mold configurations may be used within the scope of the present invention. The mold half 22 forms the front face of the backboard 10 and may include pins 24 for forming mounting holes in the backboard, and may further include pins 26 for forming mounting holes for the basketball hoop 12. In addition, a rib element 28 is provided extending from the bottom surface 30 of the mold half 22 a small distance for defining a recess 41 in the front face of the finished backboard 10.

Referring to FIGS. 2 and 3, a graphics sheet 18 is moved into association with the open second mold half 22, and in the preferred embodiment, the graphics sheet 18 is moved by an automated delivery means, depicted diagrammatically as element 32, which is adapted to grip and move the graphics sheet 18 to a desired location. When the graphics sheet 18 is adjacent to the surface 30 of the mold half 22, it is placed into engagement with the surface 30 such that a peripheral edge 34 of the graphics sheet 18 is in contact with a surface defined by the rib 28 around substantially the entire peripheral edge of the graphics sheet 18. In addition, the graphics sheet is provided with holes 36 and 38 for receiving the pins 24 and 26 therethrough. The surface defined by the rib 28 contacting the edge of the sheet 18, and the pins 24, 26 engaging in the holes 36, 38 facilitate proper alignment of the graphics sheet 18 within the mold.

It should be noted that the graphics sheet 18 includes a printed side on a front face thereof and that the printed side is placed face down toward the surface 30 as the sheet 18 is placed within the mold half 22.

Referring to FIG. 4, the top and bottom mold halves 20, 22 are then moved into engagement with each other and a melt of structural foam material is shot under pressure into the mold cavity. When the structural foam material forming the rigid backboard structure 16 comes into contact with the unprinted back surface of the graphics sheet 18, the back portion of the graphics sheet 18 will melt to cause it to become integrally joined to the backboard structure 16. In the finished backboard 10, the graphics sheet 18 covers a substantial portion of the front area forming the rebound surface and is surrounded by a relatively narrow border area 40 with the recess 41 formed by the rib 28 located between the edge of the graphics sheet 18 and the border area 40. The border area 40 and front printed face of the graphics sheet 18 preferably lie in substantially the same plane.

Figure 6:
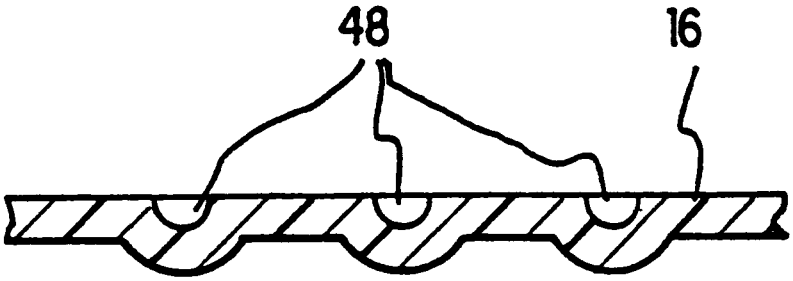
FIG. 6 is a cross-sectional view taken along line 6—6 in FIG. 1.
Figure 7:
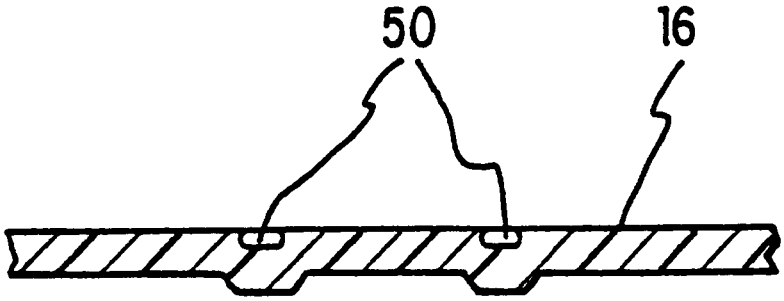
FIG. 7 is a cross-sectional view taken along line 7—7 in FIG. 1.

In addition, as may be seen in FIGS. 1, 6 and 7, the front face of the backboard 10 may be provided with further molded in recesses, such as recesses 48 and 50. The recesses 48 and 50 act to provide the front face of the backboard with a three-dimensional sculpted appearance in the border area 40 surrounding the graphics sheet 18. Thus, the recesses 48 and 50 function as a further graphics enhancing feature for the backboard 10 defining predetermined sculpted patterns on the face of the backboard.

Polyolefin materials are resistant to degradation making such materials desirable for a basketball backboard intended for outdoor use. However, the same characteristics which make polyolefin materials resistant to degradation also make them resistant to receiving inks during a printing process. Specifically, parts formed of polyolefins have a substantially nonporous external skin or surface which is not receptive to printing with conventional printing inks. Accordingly, the graphics sheet 18 of the present invention is treated to ensure that it will accept printing inks. In particular, during the production of the graphics sheet 18, prior to printing on the sheet, the side of the sheet 18 to be printed on is subjected to a corona treatment which imparts a positive charge to the sheet 18 and opens up a plurality of small pores on the sheet. The sheet is then subjected to a printing process wherein printing ink is trapped within the small pores to provide the desired graphics appearance for the sheet 18. Finally, the printed side of the sheet is coated with a U.V. coating in a silk screen process to form a laminate-like outer surface which is resistant to the deleterious effects of the weather and sun rays. Thus, the present invention provides a basketball backboard structure including an inmolded printed graphics sheet wherein the graphics sheet 18 is subjected to a particular process which permits the graphics sheet to be receptive to ink applied during a printing process.

It should be noted that it is important that the graphics sheet 18 be formed of the same base material as the polyolefin material forming the rigid structure 16 in that the polyolefin material has a relatively high shrink rate during a molding operation, as compared to other moldable materials such as styrene, for example. Thus, the shrink rate of the graphics sheet needs to be compatible or matched to the shrink rate of the rigid structure in order to avoid problems such as bowing or warping of the backboard as the backboard cools during the molding operation. In addition, forming the graphics sheet 18 and rigid structure 16 of chemically compatible materials facilitates the bonding which occurs between these elements during the molding operation.

Figure 5:
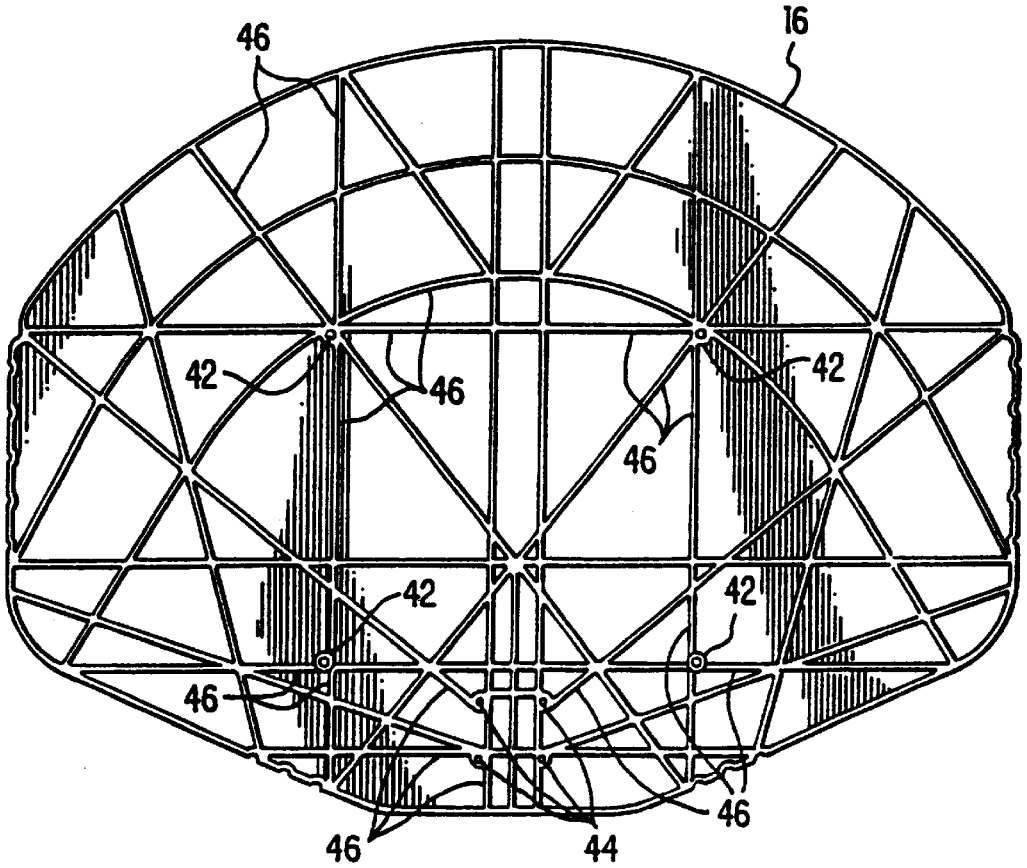
FIG. 5 is a rear elevational view of the backboard.

Referring to FIG. 5, it can be seen that the backboard 10 is provided with ribs 46 forming a reinforcing rib structure on the back side thereof. Further, it should be noted that the ribs 46 are arranged such that they extend along lines which pass tangential to backboard mounting apertures 42 and hoop mounting apertures 44 formed in the backboard 10 during the molding process. It has been found that by locating the ribs 46 tangential to the apertures 42, 44, as opposed to intersecting the apertures, the ribs are formed as uninterrupted structures such that the strength of the ribs continues along a line past the apertures 42, 44 whereby the structural foam material forming the rigid structure 16 is provided with greater structural strength in the area of the apertures 42, 44.

Further, it should be noted that the use of polyolefins for the present backboard provides a cost effective and strong structural material which is particularly conducive to constructing larger backboards, such as 48 inch backboards.

From the above description, it should be apparent that the present invention provides a basketball backboard formed of a structural foam material and including an inmolded printed graphics sheet.

Further, the present invention provides such a backboard having a graphics sheet which has been treated to facilitate printing directly on the structural foam graphics sheet material. Thus, the use of a printed polyolefin graphics sheet on a structural foam backboard formed of the same base material is facilitated through the above-described method.

While the method and article herein described constitute preferred embodiments of the invention, it is to be understood that the invention is not limited to this precise method and article, and that changes may be made therein without departing from the scope of the invention, which is defined in the appended claims.

What is claimed is:

1. A basketball backboard comprising:

a backboard structure formed of a structural foam material, said backboard structure having a front face and a rear face;

a graphics sheet attached to the front face, wherein said graphics sheet is bondable to said backboard structure during the process of molding said backboard structure, and wherein said graphics sheet has a printed side facing away from said backboard structure.

2. The basketball backboard of claim 1 wherein said graphics sheet is formed of the same base resin material as said backboard structure.

3. The basketball backboard of claim 2 wherein said structural foam material comprises a structural foam polyolefin.

4. The basketball backboard of claim 1 further comprising a recess formed in the front face of said backboard structure immediately adjacent to substantially the entire periphery of said graphics sheet.

5. The basketball backboard of claim 1, wherein said backboard structure includes a border portion defining a surface lying in substantially the same plane as said printed side of said graphics sheet, the border portion extending around a substantial portion of the periphery of said graphics sheet.

6. The basketball backboard of claim 5, wherein said backboard structure has a recess formed in the front face immediately adjacent to substantially the entire periphery of said graphics sheet, and wherein the recess is disposed between the periphery of said graphics sheet and the border portion.

7. The basketball backboard of claim 1 wherein said graphics sheet includes a coating capable of protecting said graphics sheet from the effects of environmental conditions.

8. The basketball backboard of claim 1, wherein said graphics sheet has a plurality of pores to receive ink within the pores to define the printed side.

9. The basketball backboard of claim 1 further comprising reinforcing ribs extending from the rear face of said backboard structure and apertures at the rear face, wherein the ribs define lines passing tangentially and adjacent to the apertures.

10. The basketball backboard of claim 1, further comprising a border portion on the front face surrounding said graphics sheet, wherein the border portion has grooves defining a sculpted three-dimensional appearance on the front face.

11. The basketball backboard of claim 1 wherein said graphics sheet is bondable to said backboard structure during the process of injection molding said backboard structure.

12. The basketball backboard of claim 1 wherein said graphics sheet is bondable to said backboard structure during the process of compression molding said backboard structure.

13. A basketball backboard comprising:

a rigid backboard structure formed of a molded plastic material, said backboard structure having a front face and a rear face;

a hole in said backboard structure;

a reinforcing rib extending from said rear face; and wherein said reinforcing rib extends tangentially and adjacent to said hole.

14. The basketball backboard of claim 13 further comprising a plurality of holes in said backboard structure and a plurality of reinforcing ribs extending tangentially and adjacent to the plurality of holes.

15. The basketball backboard claim 13 wherein said backboard structure is formed of a molded structural foam material and said backboard structure has a graphics sheet on the front face.

16. The basketball backboard of claim 15, wherein the graphics sheet includes a plurality of pores to receive ink within the pores to define the printed side.

17. The basketball backboard of claim 15, wherein the graphics sheet is bonded to the front face through an injection molding process.

18. The basketball backboard of claim 15, wherein the graphics sheet is bonded to the front face through a compression molding process.

19. The basketball backboard of claim 15, wherein the mold includes a surface that defines a recess in the backboard structure extending around substantially the entire periphery of the graphics sheet when the backboard structure is formed.

20. The basketball backboard of claim 19, wherein the step of forming the backboard structure includes forming a border portion surrounding the recess wherein the border portion defines a surface lying in substantially the same plane as the graphics sheet.

21. A basketball backboard of a structural foam material produced by the process of:

providing a mold and a sheet of polyolefin material;

treating the sheet to prepare it for receiving printing inks;

printing one side of the sheet with ink to form a graphics sheet having a printed side;

placing the graphics sheet in said mold; and supplying a melt of material formed of the same base material as the graphics sheet to the mold to thereby form a rigid backboard structure and simultaneously bond the graphics sheet to the backboard structure.

22. The basketball backboard of claim 21 wherein the backboard structure is formed from a structurally foamed polyolefin.

* * * * *